United States Patent [19]

Stoner et al.

[11] 4,282,796

[45] Aug. 11, 1981

[54] DOUBLE ACTING, PNEUMATIC BOLT AND SEAR BUFFER FOR AUTOMATIC CANNON

[75] Inventors: Eugene M. Stoner, Stuart, Fla.; Richard R. Gillum, Marblehead, Ohio

[73] Assignee: ARES, Inc., Port Clinton, Ohio

[21] Appl. No.: 24,185

[22] Filed: Mar. 27, 1979

[51] Int. Cl.[3] ..... F41D 11/12

[52] U.S. Cl. ..... 89/198

[58] Field of Search ..... 89/198, 199

[56] References Cited

U.S. PATENT DOCUMENTS

| | | | |
|---|---|---|---|
| 2,108,026 | 2/1938 | Sutter et al. | 89/198 |
| 2,496,323 | 2/1950 | Waltke | 89/198 |
| 3,566,744 | 3/1971 | Stoner | 89/199 |
| 3,757,636 | 9/1973 | Chiabrandy | 89/198 |

FOREIGN PATENT DOCUMENTS

| | | | |
|---|---|---|---|
| 336758 | 5/1921 | Fed. Rep. of Germany | 89/198 |

*Primary Examiner*—Stephen C. Bentley

*Attorney, Agent, or Firm*—Allan R. Fowler

[57] ABSTRACT

For an automatic cannon, a pneumatic bolt and sear buffer comprises a housing fixed rearwardly of a breech ring, a cylinder, an end plate and a low mass piston projecting forwardly through the cylinder. A pin transversely installed through the piston, into slots in the cylinder and housing, limits relative axial movement between the piston, cylinder and housing. A forward cylinder flange also limits rearward cylinder movement relative to the housing. Pressurization of gas in a pressure chamber defined by the cylinder, piston and end plate is through an end plate valve. A bolt sear is pivotally mounted to a sear bracket extension of the cylinder, forwardly of the piston. After firing, recoil impact of a reciprocating bolt assembly drives the piston rearwardly into the cylinder, and upon bolt searing the cylinder is pulled forwardly relative to the piston; in both cases the buffer gas is further compressed, acting as a massless spring. A sear support or keeper is provided to prevent hitting and bouncing of the sear by the searing up.

9 Claims, 14 Drawing Figures

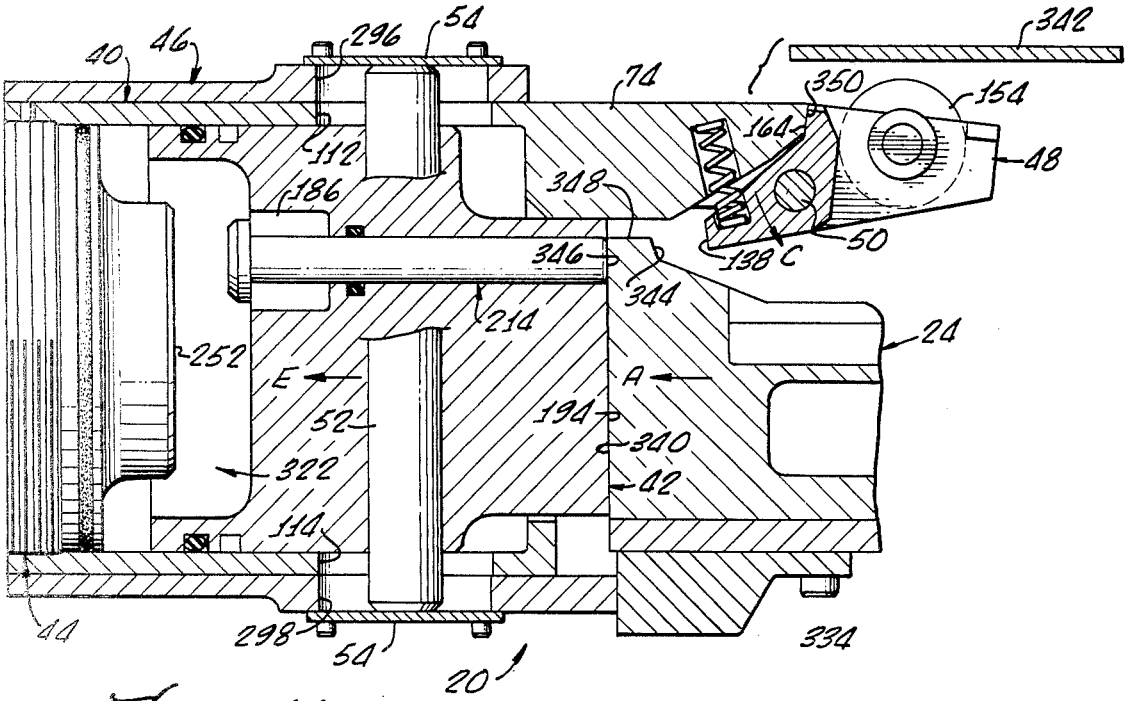
FIG. 11.
FIG. 12.
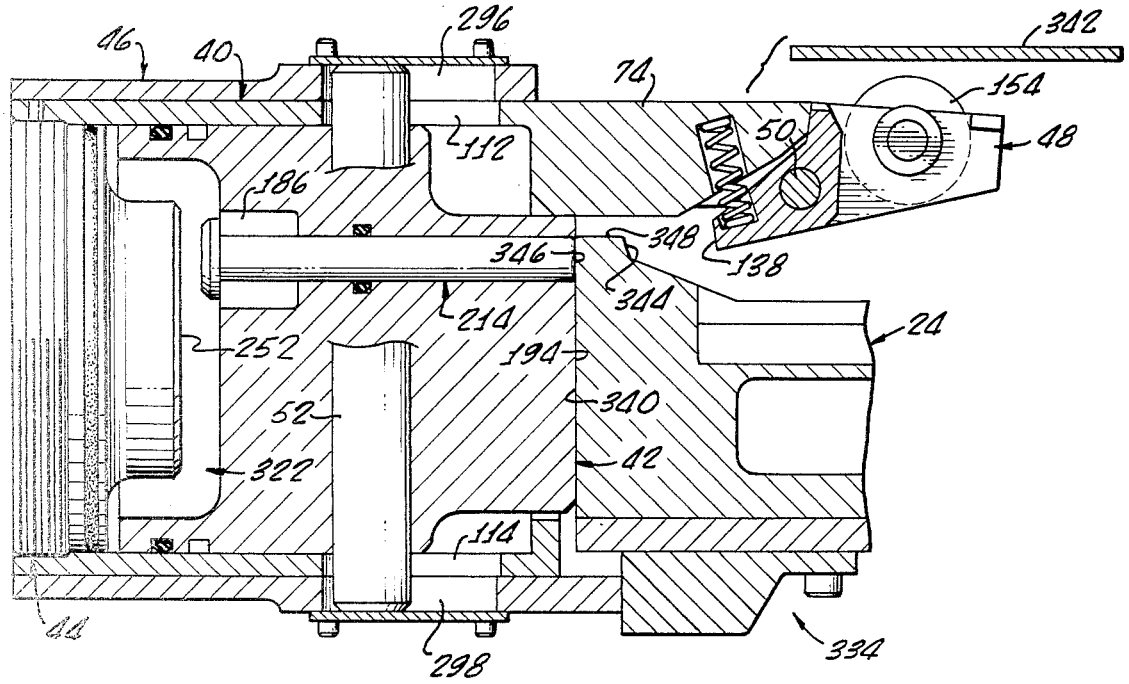

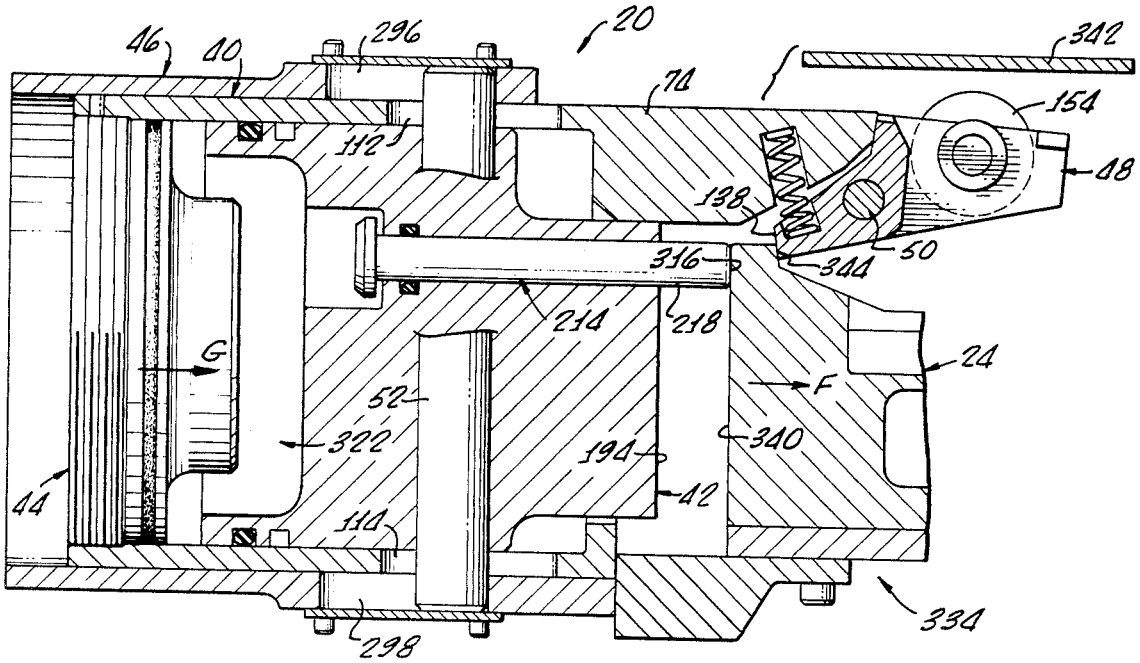
FIG. 13.
FIG. 14.
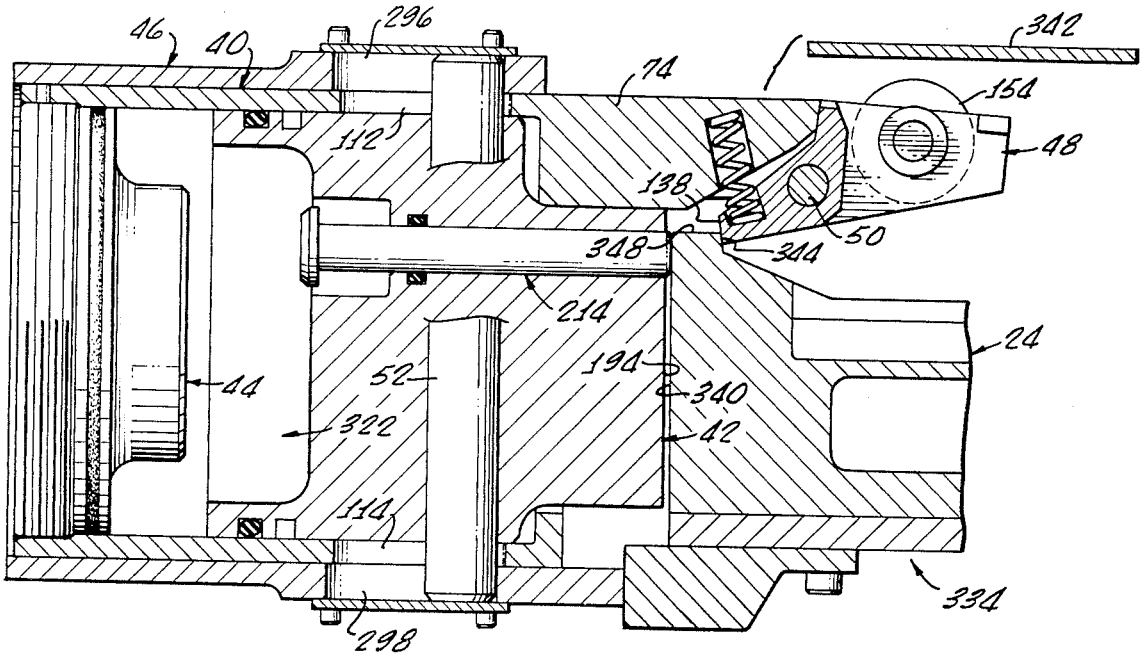

DOUBLE ACTING, PNEUMATIC BOLT AND SEAR BUFFER FOR AUTOMATIC CANNON

The present invention relates generally to the field of bolt recoil and sear buffers for automatic guns, and more particularly to double acting, bolt recoil and sear buffers used in automatic cannon, such as anti-aircraft cannon.

Most large, automatic cannon, particularly those types commonly used in anti-aircraft systems have a single barrel with a single firing chamber at the breech. In typical operation, a bolt assembly, comprising a bolt and bolt carrier, axially reciprocates between the breech and a rearwardly fixed recoil buffer.

When firing is initiated by unsearing the rearwardly positioned bolt assembly, springs connected to the carrier drive the assembly forwardly towards the breech. As an associated shell feeder is passed, the bolt assembly picks up a shell and rams it forwardly into the firing chamber. Upon impact with the breech, the bolt is temporarily locked thereto, while the carrier continues a short distance forwardly to interfere with bolt unlocking and to fire the shell.

Normally, after firing, pressurized gas bled from the barrel is used to recoil the bolt carrier, thereby enabling, or causing, bolt unlocking. Barrel gas pressure acting on the bolt face through the fired shell casing then drives the bolt, as well as the carrier, rapidly rearwardly in recoil. During such recoil stroke, the fired shell casing is extracted or driven from the breech by gas pressure, and ejected from the cannon.

Upon rearward impact with the buffer, recoil kinetic energy of the bolt assembly is absorbed thereby to stop recoil. Immediate release of at least portions of this absorbed energy drives the bolt assembly back forwardly in counterrecoil to repeat the firing sequence. After firing is initiated, most of the forward driving force of the bolt assembly is provided by the recoil buffer, as is necessary for rapid, automatic firing.

For effectiveness, a high firing rate is required of most automatic cannon, thereby necessitating high bolt assembly recoil and counterrecoil velocities. Since bolts of large cannon are relatively massive, these high bolt assembly recoil velocities require the buffers to be capable of absorbing very large amounts of kinetic energy and of subsequently releasing most of this energy so that bolt assembly counterrecoil velocity is approximately equal to recoil velocity.

Typically, recoil buffers heretofore available have employed coil or dished-washer mechanical springs to absorb and return bolt assembly kinetic energy. However, at least for large automatic cannons, mechanical spring buffers are relatively inefficient, buffer efficiency being defined as the ratio of bolt assembly counterrecoil velocity (imparted by the buffer) to recoil velocity. To absorb high kinetic energies the springs must be large, and hence massive. Consequently, upon rexpansion to return energy to the bolt assembly, substantial energy is wasted in accelerating the spring mass and is unavailable to accelerate the bolt assembly.

This creates an undesirable situation in which, to achieve high firing rates the bolt assembly must be recoiled at very high velocities to compensate for lower counterrecoil velocities caused by buffer inefficiency. However, as recoil velocity is increased, efficiencies of mechanical spring buffers tend to decrease, requiring further increase of recoil velocities. As an illustration, mechanical spring buffers for typical 35 mm cannon having firing rates of about 600 rounds per minute, have efficiencies less than about 0.75. A limiting factor to firing rate then becomes overstress and damage of parts caused by high bolt assembly recoil kinetic energy.

It is therefore apparent that if buffer efficiency can be increased, total bolt assembly cycling time can be reduced even at moderate recoil velocities, and firing rates can be accordingly increased. When existing firing rates are considered adequate, increased buffer efficiency enables reducing present bolt recoil velocity with attendant reduction of stresses now associated with excessively high recoil velocities and increased parts life.

In addition to this relative inefficiency, size and weight of mechanical spring buffers in large automatic cannon makes such buffers undesirable in applications where size and/or weight are important, as in many mobile systems or where the cannon are mounted on aircraft.

Similar problems are associated with apparatus for searing up the bolt assembly when firing is to be interrupted or terminated. To enable the above mentioned shell pick up after unsearing of the bolt assembly, the seam must be located rearwardly, near the recoil buffer to engage the bolt assembly upon leaving the recoil buffer with maximum counterrecoil velocity and energy. Because very high impact stresses are caused by abrupt sear-bolt assembly engagement, the searing up must be softened (buffered) to prevent damage to the associated parts.

As a result, many cannon having mechanical recoil buffers also configure the buffer to serve as a sear buffer. In such dual action buffers, recoil impact causes rearward compression of the springs and sear impact causes forward compression of the springs. Other types of cannon alternatively employ separate mechanical or hydraulic sear buffers, thereby adding substantial weight and size to the cannon.

As an example of apparent attempts to eliminate or reduce problems associated with large, mechanical spring buffers, Oerlikon, a major munitions manufacturer, utilizes hydraulic recoil buffers in at least one family of 35 mm automatic cannon (type GDM-A and variations thereof). A slightly compressible silicon liquid, confined within a buffer cylinder functions as a fluid spring for absorbing and subsequently returning bolt assembly energy.

However, because of very high hydraulic pressures caused by bolt assembly-buffer impact, such buffers are constructed relatively small in diameter to avoid having to be very massive. This results in "hard" buffering with attendant high parts stress and reduced part life and reliability. Although weight reduction is ordinarily achieved, these hydraulic buffers are generally not substantially more efficient than mechanical spring buffers in imparting counterrecoil to the bolt assembly.

Furthermore, space and weight savings which may result from use of the hydraulic buffers are largely offset by use of separate, relatively massive mechanical, spring sear buffers.

Another disadvantage of Oerlikon-type hydraulic buffers is the additional complexity necessary for accomodating thermal expansion of the silicon fluid, a separate fluid expansion chamber being typically connected to the main buffer chamber by a capillary for such purpose. The capillary is sufficiently small in cross section to isolate the main chamber from the expansion chamber during the rapid recoil buffering action.

In contrast, high or very high firing rates are achieved by other, less conventional types of automatic cannon without most of the above-mentioned problems, but with other substantial limitations and problems.

Typical of such automatic cannons are multi-barrel, Gatling gun types and single or double barreled cannon employing multi-chambered revolving cylinders similar to those used in conventional pistols. The General Electric type M61A11, eight barreled 20 mm cannon and the Oerlikon proto-type, KCA304KR four chambered 30 mm cannon are respective examples of these types of weapons.

Although very effective, because of massive fire power, in many applications, these types of cannon cannot be universally used. For example, the very high rate of fire of the Gatling gun types (up to several thousand rounds per minute) is attained by rapidly rotatably driving the multi-barrel assembly with a large electric or ram air motor requiring considerable power. Such power, while usually available in most aircraft applications for which the cannon are principally designed, is often not available for mobile ground applications, particularly for large cannon with large power drive requirements.

Furthermore, the number of shells fired as the barrels are spun up to full rotational speed are generally inaccurate and cannot easily be compensated for by offset aiming, as can the throw caused by spinning when the barrels are spun to full, constant speed. This spin-up inaccuracy tends to limit Gatling gun type cannon to small calibre guns which fire relatively large numbers of shells, so that inaccuracies of the first shells fired every time barrel rotation is started can be neglected. In larger calibre cannon, such as used in anti-aircraft or anti-tank applications, shells are large and shell capacity is ordinarily relatively limited. Thus, the shells are generally fired in short bursts of 5 to 10 shots, and accuracy of each shell is critical.

A further problem with both Gatling gun and revolver types of cannon is that when firing is interrupted or stopped, unfired shells are left in some of the barrels or chambers. After a number of shells have previously been fired, the barrels or chambers are so hot that there exists a substantial probability that any still chambered shells will be fired by the heat. Such unintended and unpredictable "cook-off" firings are particularly dangerous in revolver type cannon because no barrel is aligned with most of the cylinders.

Hence, in small calibre cannon, having relatively expendable shells, unfired shells left in chambers or barrels after firing are dumped by mechanical actuation. However, in larger calibre cannon, shells cannot generally be wasted in this manner and a problem would exist as to whether or not the unfired shells could be sufficiently rapidly removed, without damage to the shells, to prevent cook-off firing and without endangering the gun crew.

For these and other reasons, Gatling-gun and revolver type cannon are not generally constructed in the larger calibres necessary for moderate range anti-aircraft or for anti-tank applications.

Thus, for these and other types of applications, higher cannon firing rates or improved cannon performance must be achieved by improving the characteristics of more conventional automatic cannon, for example, by substantially improving recoil and sear buffers in the manner disclosed herein by the applicant to increase cycling speed.

According to the present invention, a pneumatic double acting bolt recoil and sear buffer apparatus, in an automatic cannon having a breech and a bolt assembly operative for recoiling rearwardly along a recoil and counterrecoil path from the breech in response to firing of the cannon and having firing means for selectively controlling searing and unsearing of the bolt assembly and firing of the cannon comprises a buffer housing disposed on part of the cannon rearwardly of the breech and a recoil and sear buffer disposed in the housing.

Included in the buffer are searing means reponsive to the firing means for searing up the bolt assembly on counterrecoil thereof and a gas pressure chamber containing a pressurized gas. Means are included for compressing the pressure chamber and the gas contained therein, in response to rearwardly directed bolt assembly recoil impact, to stop bolt assembly recoil, and to forwardly directed searing up impact of the bolt assembly, to soften searing up of the bolt assembly. The chamber compressing means are also operative for enabling subsequent rapid reexpansion of the pressure chamber and the gas contained therein after bolt assembly recoil is stopped, to thereby cause counterrecoil of the bolt assembly towards the breech at a velocity substantially equal to bolt assembly recoil velocity.

In this manner, the buffer apparatus provides the important dual functions of softening searing up of the bolt assembly by the searing means, as well as stopping recoil of the bolt assembly and imparting high counterrecoil velocity thereto.

More particularly, the pressure chamber and the chamber compression means include a buffer cylinder, means for closing the rearward end of the cylinder and a buffer piston axially slidably disposed in the cylinder. The searing means is connected to forward portions of the cylinder and the cylinder is configured to provide bolt assembly recoil impact access to forward portions of the buffer piston. Rearward movement of the piston relative to the cylinder, in response to bolt assembly recoil impact, and forward movement of the cylinder relative to the piston, in response to bolt assembly searing up, causes compressing of the pressure chamber and further compression of gas contained therein, the gas thereby functioning as a spring for both bolt assembly recoil and sear buffering.

Because the pressurized gas in the pressure chamber acts as a virtually massless spring, substantially all the energy absorbed by the pressure chamber to stop bolt assembly recoil is returned, by gas expansion, to the bolt assembly to cause high velocity counterrecoil thereof.

The buffer is disposed in the housing in the recoil path of the bolt assembly, the cylinder being formed having at least a partially open forward end through which portions of the piston project forwardly for impact by the bolt assembly. A forward face of the piston is configured similarly to a rearward, impacting face of the bolt assembly.

Included in the means for closing the rearward end of the cylinder is an end cap and means for detachably fixing the end cap to the cylinder. Removal of the end cap, which preferably includes a pressure valve communicating therethrough, enables the piston to be easily installed into, and removed from, the cylinder.

Preferably, the housing includes means for detachably fixing the housing to the cannon, to thereby enable removal of the buffer apparatus from the cannon as a unit. In addition, however, the housing includes means defining an open rearward end through which access is provided to the pressure valve for pressurizing the pressure chamber and through which the end cap and piston can be easily and rapidly removed or installed for maintenance purposes without removing the entire buffer apparatus from the cannon.

Piston and cylinder travel limiting means comprises a piston pin installed through the piston orthogonally to the piston axis, ends of the pin being confined by axially elongated slots in the housing and cylinder, and retained therein by retaining plates mounted to the housing. During operation, the pin limits rearward axial movement of the buffer cylinder relative to the housing when the chamber is compressed in response to bolt assembly recoil impact and limits forward axial movement of the piston relative to the housing when the chamber is compressed in response to searing up impact of the bolt assembly. Rearward movement of the cylinder relative to the housing is also limited by a cylinder flange which engages forward portions of the housing.

The cylinder and housing slots are, however, formed having axial lengths enabling the piston to travel rearwardly relative to the cylinder and housing, in response to bolt assembly recoil impact, without the piston pin engaging rearward ends of the slots, so long as a preselected static pressure level is maintained in the pressure chamber. Since piston travel is normally limited by pressure buildup in the pressure chamber during piston movement, and not by pin-slot end engagement, energy loss in the buffer is minimized.

Leaking of pressurized gas from the pressure chamber is prevented by sealing means for pressure sealing the end cap and piston relative to the cylinder.

Also included in the buffer apparatus are means for preventing impact between the bolt assembly on recoil thereof and the searing means when released by the cannon firing means, bouncing of the searing means and consequent improper bolt assembly searing being thereby prevented. Such preventing means includes a sear keeper having a sear support portion mounted to be moveable by the bolt assembly, on recoil engagement therewith, from a first position supporting the searing means out of the bolt assembly recoil path to a second position releasing the searing means to enable searing up of the bolt assembly on counterrecoil, and further including biasing means for urging said sear support portion towards said first position. In the gas buffer, the sear keeper is installed through the piston so as to be urged forwardly by gas pressure in the pressure chamber. In a static condition the sear keeper supports the released searing means out of the path of bolt assembly recoil. Impact by the recoiling bolt assembly drives the sear keeper into the piston to release the searing means to extend into the bolt assembly recoil and counterrecoil path to enable searing up of the bolt assembly on counterrecoil thereof.

The sear keeper apparatus has applicability to virtually any type of searing means which sears up a reciprocating bolt assembly on counterrecoil by moving searing portions into the path of the bolt assembly during counterrecoil thereof such that the bolt assembly impacts the searing portion on recoil before engagement on counterrecoil. Bouncing of the searing portion with subsequent unreliable searing up of the bolt assembly, as a result of the impact on recoil is prevented by the sear keeper which keeps the searing portion out of the bolt assembly recoil path until the bolt assembly moves the sear keeper out of sear supporting relationship as the bolt assembly recoils under the searing portion. The searing portion is then free to extend or move into the bolt assembly counter recoil path to cause searing up as the bolt assembly moves past forwardly in counterrecoil.

A better understanding of the present invention may be had from a consideration of the following detailed description, taken in conjunction with the accompanying drawings in which:

FIG. 11 is a cross-sectional view similar to FIG. 10, but at an instant later, showing the piston being rearwardly driven by the recoiling bolt assembly to compress gas in the buffer chamber;

FIG. 12 is a cross-sectional view similar to FIG. 11 at another instant later, showing the piston driven to near its maximum rearward position and recoil of the bolt assembly stopped by the buffer apparatus;

FIG. 13 is a cross-sectional view similar to FIG. 12, an instant later, showing the bolt assembly seared up on counterrecoil from the buffer chamber; and FIG. 14 is a cross-sectional view similar to FIG. 13, showing the buffer apparatus in an equilibrium condition with the bolt assembly seared up.

Figure 1:
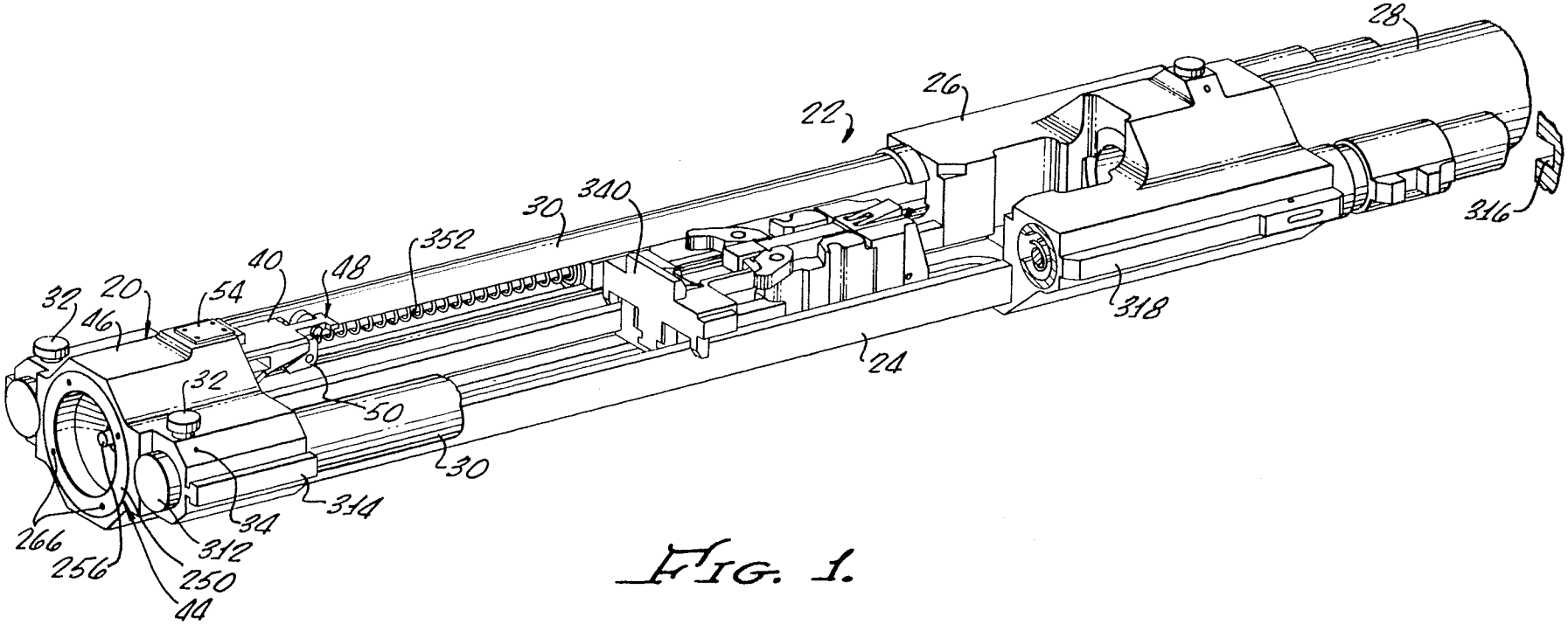
FIG. 1 is a partially cut away perspective drawing, showing a high efficiency, pneumatic bolt and sear buffer apparatus connected to rear portions of an exemplary automatic cannon.

As seen in FIG. 1, a double acting, pneumatic bolt recoil and sear buffer apparatus 20, according to the present invention, is fixed to a rearward end of an associated gas operated, automatic cannon or gun 22. As described below, the buffer apparatus 20 is constructed to impart counterrecoil velocity to a cannon bolt or bolt assembly 24 which is substantially equal to recoil velocity thereof, firing rate of the cannon 22 being thereby enhanced and stresses reduced. Also as described, the buffer 20 is constructed to soften bolt searing, thereby reducing sear impact stresses and cannon damage caused thereby.

Although the buffer apparatus 20 is adapted for use, either in the form illustrated or with modifications apparent to those skilled in the art, with most types of gas operated automatic cannon, for illustrative and descriptive purposes the associated cannon 22 is shown to be the open framework receiver type disclosed in copending patent application, Ser. No. 024,186, filed on even date herewith. Principal features of the cannon 22, briefly described, are a partially open breech ring 26 to which is mounted a firing chamber end of a cannon barrel 28. Passing through opposite side regions of the breech ring 26, in symmetrical relationship, are two parallel, elongate support and recoil cylinders 30 which extend forwardly of the breech ring and are connected at forward ends to a barrel support ring (not shown).

Also for the particular type of cannon 22 illustrated, the buffer 20 is detachably mounted to a rearward end of each of the cylinders 30 by retaining elements 32 held in place for example, by spring loaded detent pins 34. During firing, reciprocating movement of the bolt assembly 24, between the breech ring 26 and the buffer apparatus 20, is guided by the cylinders 30 and otherwise as described below.

Shown in exploded perspective in FIG. 2, the buffer apparatus 20 comprises generally a combination buffer cylinder and sear bracket 40 (hereinafter referred to as the buffer cylinder), a buffer piston 42, a detachable buffer cylinder rear cap or plate 44 and a buffer housing 46. Also included are a spring loaded sear 48, with an associated pivot and mounting pin 50, an elongate piston retaining pin 52, and two piston pin retaining plates 54 attached, on assembly, to the housing 46 by a plurality of cap screws 56.

When assembled and pressurized as described below, the cylinder 40, the piston 42, which is axially slidably received in the cylinder, and the end plate 44, which is threaded into a rearward end of the cylinder 40, form an axially compressable buffer chamber 62, pressurized gas contained therein functioning as a virtually massless spring.

The buffer chamber 62 is configured for being axially slidably received in the buffer housing 46, rearward travel of the buffer, relative to the housing, being limited by an outwardly extending, generally peripheral flange 64 at a forward end of the buffer cylinder 40. As above mentioned, the housing 46 is in turn detachably mounted to rearward ends of the cylinders 30 by the elements 32. It is to be appreciated, however, that with other types of cannon a comparable housing may alternatively be formed as an integral portion of a generally conventional cannon receiver.

Figure 2:
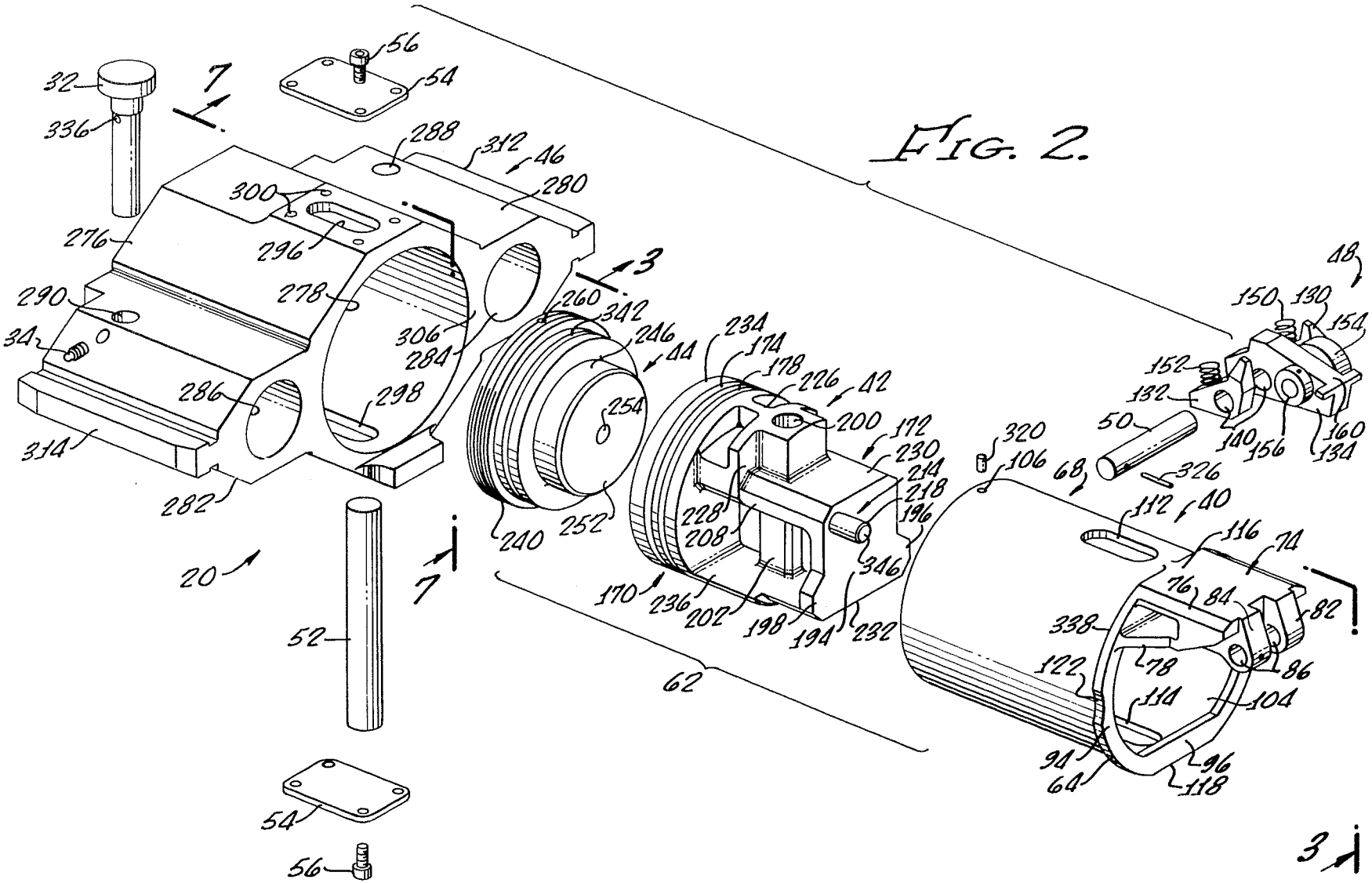
FIG. 2 is an exploded perspective drawing of the buffer apparatus of FIG. 1, showing elements and features of the apparatus.
Figure 3:
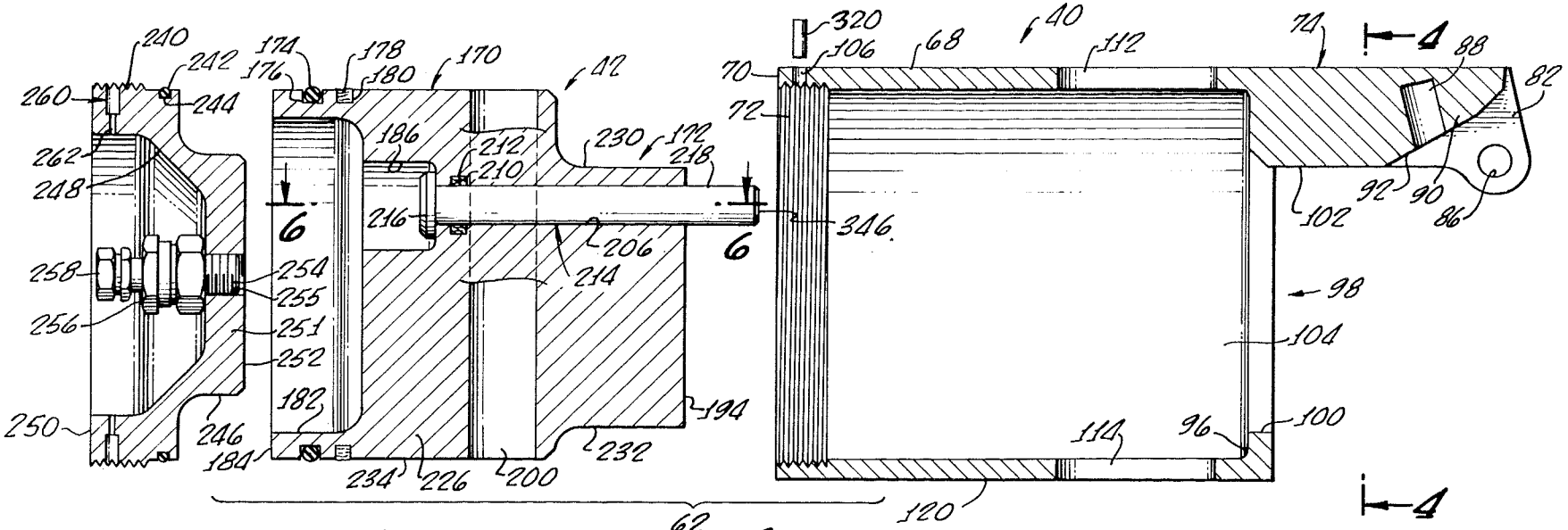
FIG. 3 is a vertical sectional view, taken along line 3—3 of FIG. 2, showing features of cylinder, piston and end cap portions of the buffer apparatus.
Figure 4:
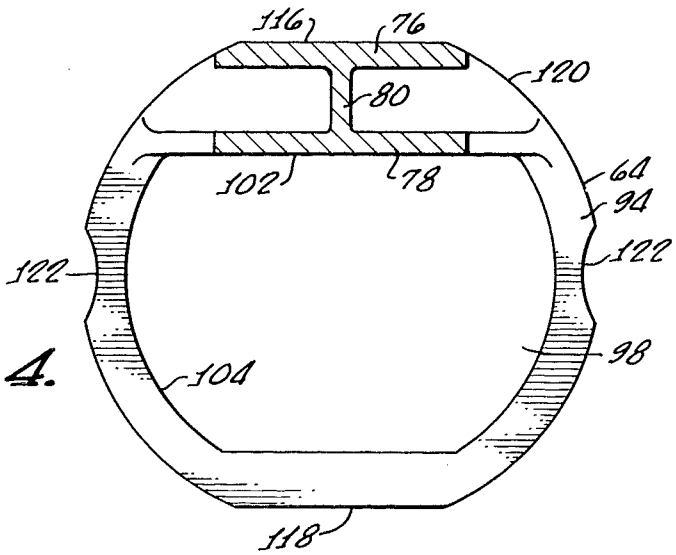
FIG. 4 is a vertical sectional view taken along line 4—4 of FIG. 3, showing features of a sear bracket portion of the buffer cylinder.

More particularly described and as seen in FIGS. 2–4, the buffer cylinder 40, formed symmetrically about a vertical, centerline plane, includes a generally hollow cylindrical body 68 with an open rearward end defined by a rearward facing, annular surface 70. A rearward end region 72 of the body 68 is internally threaded to receive the end plate 44.

Extending forwardly from the cylinder forward flange 64, at an upper region of the cylinder 40, is a strong, rigid sear bracket portion 74 to which, on assembly, the sear 48 is mounted by the pin 50. To resist bending due to off-axis sear loading, the sear bracket portion 74 is formed in a generally "I"-beam cross-section, having an upper transverse leg 76, a spaced below, lower transverse leg 78 and a vertical, central web section 80 interconnecting the legs.

At forward regions of the sear bracket portion 74 are forwardly projecting, laterally spaced apart first and second sear mounting ears 82 and 84, through each of which is formed a transverse aperture 86 for receiving the sear mounting pin 50. Pivot pin shear loading, in operation, is thereby distributed over four shear regions, enabling required strength without excessive size or mass.

Sear spring receiving recesses 88 (only one of which is shown) are formed upwardly and slightly rearwardly into undersides of the ears 82 and 84, rearwardly of the apertures 86. A central sear bracket portion 90, intermediate the ears 82 and 84, is constructed having a downwardly and rearwardly angled lower surface 92 which functions as a sear stop when the sear is in an unseared position.

Below the sear bracket portion 74, a forward, generally annular cylinder face 94 of the cylinder body 68, largely defined by the flange 64, is substantially open to permit, on assembly, forward portions of the piston 42 to project therethrough. A wider, lower region of the face 94 is formed by an upwardly (radially inwardly) directed flange 96. In this manner, a forward cylinder opening 98 is defined, around edges thereof, by a flat transverse upper surface 100 of the flange 96, a transverse lower surface 102 of the bracket lower leg 78 and an inner wall surface 104 of the body 68.

A small, radial end cap locking pin aperature 106 is formed through the body 68 in the rearward end region 72 . Axially elongated, opposing upper and lower slots or apertures 112 and 114, respectively, are formed through upper and lower wall portions of the cylinder body 68, just rearwardly of the flange 64 and about a vertical centerline plane, for receiving ends of the piston retaining pin 52.

For clearance purposes, the flange 64 is formed having respective upper and lower transverse outer edge surfaces 116 and 118 (FIG. 4) which are substantially flush with an outer surface 120 of the body 68, and having side notches or cutouts 122 along a horizontal centerline plane, for cleaning the cylinders 30.

Figure 5:
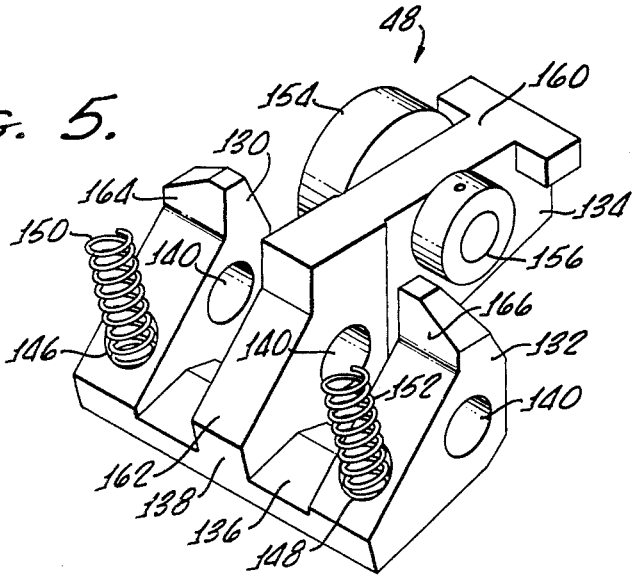
FIG. 5 is a perspective drawing showing a sear portion of the buffer apparatus.

Sear buffering, that is, reduction of searing up impact stresses caused when, during gun operation, the sear 48 engages the bolt assembly 24 to stop or interrupt firing of the cannon 22, is enabled by mounting the sear to the buffer cylinder forward portion 74 with the sear forwardly of other assembled portions of the buffer 20. As seen in FIGS. 1 and 5, the sear 48 is constructed to mate with the buffer cylinder forward portion 74, having first and second ears 130 and 132, which correspond respectively to the buffer cylinder ears 82 and 84, and which are laterally spaced to sides of an elongate central portion 134 by a transverse web 136.

Formed transversely across the ears 130 and 132, the central portion 134 and the web 136 is a rearwardly facing sear surface 138 for engaging the bolt assembly 24 on searing up, as described below. A transverse mounting pin aperture 140, corresponding to the cylinder aperture 86, is formed through the ears 130 and 132 and the central portion 134 in a location forward and above the sear surface 138.

First and second recesses 146 and 148 are formed downwardly into the ears 130 and 132, respectively, intermediate the sear surface 138 and the mounting pin aperture 140, for receiving first and second sear springs 150 and 152.

Operation of the sear during firing of the cannon 22 is enabled by a large roller 154 pivotally mounted to one side of the sear central portion 134 by a pivot pin 156. Positioning of the pivot pin 156 is forwardly of, and above, the mounting pin aperture 140 a distance sufficient to enable upper portions of the roller 154 to project well above an adjacent central portion upper surface 160. The roller 154 enables external searing up operation of the sear 48, forces applied to the roller even though the buffer apparatus 20 may be recoiling with the barrel 28 at the time of operation.

A downwardly and rearwardly inclined rearward surface 162 of the central sear portion 134 functions as a sear stop surface, corresponding to the sear stop surface 92 of the sear bracket portion 74. Upper, rear surface regions 164 and 166 of the ears 130 and 132, respectively, limit downward pivoting of the sear 48 against the springs 150 and 152, as described below.

Exact configuration of the sear 48, however, as can be appreciated, is determined by particular configuration of the associated bolt assembly 24 which must be engaged by the searing surface 138 and by the particular type of triggering mechanism used on the cannon 22.

Figure 6:
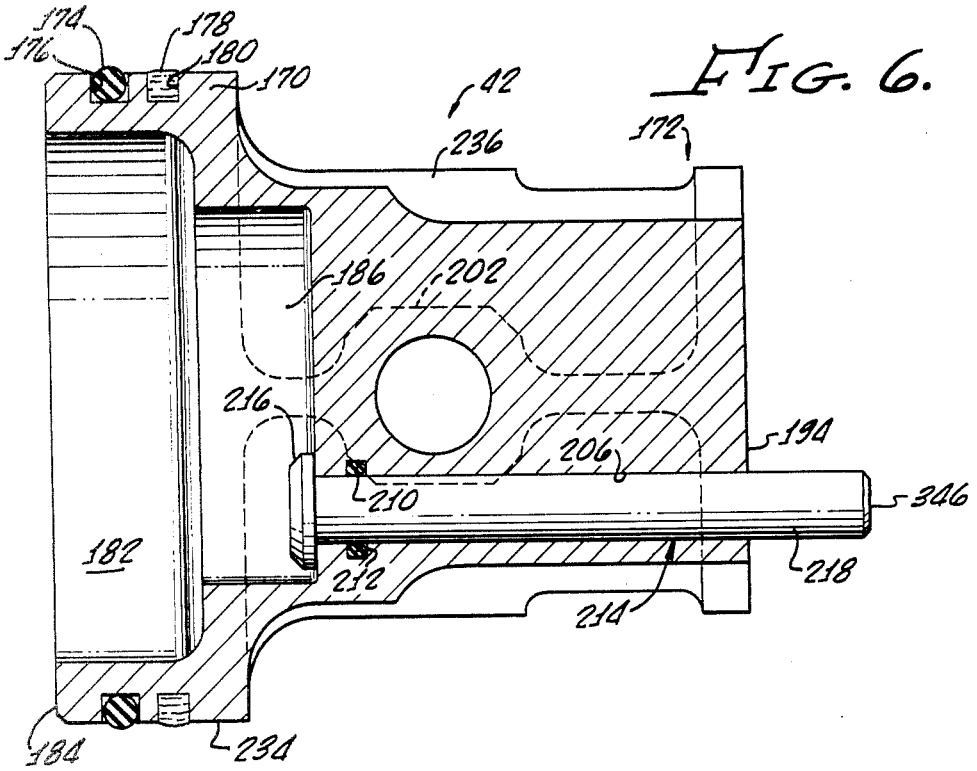
FIG. 6 is a horizontal sectional view taken along line 6—6 of FIG. 3, showing features of the buffer piston.

As seen in FIGS. 2, 3 and 6, the buffer piston 42 is formed having a relatively complex shape due to a trade off between strength and lightweight considerations. That is, the piston 42 must be sufficiently strong to withstand repetitive, high energy recoil impact by the bolt assembly 24 without damage. At the same time, however, the piston 42 must be sufficiently lightweight, compared to weight of the bolt assembly 24, that during operation little buffer absorbed, bolt assembly recoil energy is lost or wasted in decelerating and accelerating the piston.

Because of this trade off, the piston 42 can best be visualized as being formed from a solid cylinder of high strength material from which all structurally non-essential material is eliminated, for example, by machining.

To this end, the piston 42 is formed having a relatively axially short, generally cylindrical rear portion 170 and a relatively elongate, shaped forward portion 172.

Subsequent pressure sealing, relative to the cylinder 40, is enabled at the rear portion 170, by a conventional seal 174, for example, an "O" ring, installed in a first annular groove 176. Forwardly of the seal 174, a conventional wiper ring 178 is installed in a second, annular groove 180.

Buffer chamber length is minimized by forming forwardly into the rear portion 170 a cylindrical first recess defined by an inner surface 182 and an annular rear piston surface 184. A smaller, generally rectangular second recess, defined by an inner surface 186, is formed forwardly into the rear portion 170 from the first recess, above the axis of the piston.

Configuration of the piston forward portion 172 is determined, at least in part, by size and shape of rearward portions of the bolt assembly 24 that impact the piston 42 during firing of the cannon 22. In practice, this impacting region, which is referred to as bolt assembly imprint area, is ordinarily determined by preexisting configuration of the particular bolt assembly 24 employed in the cannon 22, and may vary accordingly. Also influencing size and shape of the imprint area are impact strength considerations as well as necessity for clearing other portions of the cannon during bolt assembly reciprocating movement. Preferably, the geometric center of the imprint area is located as closely as possible to the buffer (and hence barrel bore) axis; although, some below-axis offset, as can be seen in the present instance, is ordinarily necessary.

Accordingly, the piston forward portion 172 is formed having a forward transverse impact receiving face 194 which corresponds generally in size and shape to the bolt assembly 24 imprint area. As shown, (FIG. 2) the face 194 is generally rectangular, with relatively small first and second sidewardly projecting regions 196 and 198 at lower regions thereof.

For receiving the piston pin 52, a first aperture 200 is formed through the piston 42, having an axis, in a vertical plane through the piston axis and orthogonal thereto. Defining and surrounding the aperture 200 is a generally rectangular structural region 202.

A second aperture 206, orthogonal to the first aperture 200, is formed through the piston 42, in a region 208, to have a long axis parallel to, but displaced to one side of and above the piston axis. Extending between the piston face 194 and the second recess surface 186, the aperture 208 includes an annular groove 210 formed near such recess surface and in which is mounted a conventional "0" ring-type pressure seal 212.

Bouncing of the sear 48, due to bolt assembly impact just before searing up of the bolt assembly 24, as described below, is prevented by a sear keeper pin 214 installed through the second aperture 208. A head portion 216 of the pin 214 is disposed within the second recess defined by the surface 186. With such head portion 216 against the surface 186, a forward end portion 218 of the pin 214 extends forwardly well beyond the piston face 194.

Other features of the piston 42 include a central vertical web 226 formed about a vertical plane through the piston axis and an upper, vertical transverse web 228 formed rearwardly of the piston pin aperature 208. Upper and lower horizontal transverse surfaces 230 and 232, respectively, define upper and lower edges of the piston face 194. Such surfaces 230 and 232 are spaced apart a clearance distance corresponding to the spacing between surfaces 100 and 102 of the buffer cylinder 40.

A symmetrical, but irregular in outline exterior cylinder bearing surface 234 thus extends around the piston rear portion 170, in upper regions along the webs 226 and 228 and around the first aperature 200 in the region 202 and in lower regions around the bottom of a lower transverse web 236 to forwardly of the first aperature. By extending portions of the surface 234 forwardly in this manner beyond the piston rear portion 170, cocking or binding of the piston 42 in the cylinder 40 during operation, as might otherwise be caused by below-axis center of bolt assembly impact, tends to be eliminated or reduced to a negligible amount.

Rearward end closing of the cylinder 40 is provided by the end cap 44, FIGS. 2 and 3, which accordingly has a threaded rear region 240 enabling the end cap to engage the corresponding threaded cylinder portion 72 for assembly. Forwardly adjacent to such threaded region 240, a conventional pressure seal 242 is installed in an annular seal groove 244.

A reduced diameter forward portion 246 of the cap 44 is formed having a diameter less than that of the piston first recess defined by the surface 182. Opening rearwardly, a cap recess defined by an inner surface 248 and an annular rear face 250, extends forwardly to a cap wall 252 having a forward face 254.

Threaded from the rear into an axial aperture 255 in the wall 252 is a conventional high pressure valve 256 of the type typically used for pressurized high pressure apparatus, such as hydraulic system pressure accumulators. Depth of the recess defined by the surface 248 is such that a sealing cap 258 on the valve 256 is recessed below the surface 250, valve protection against accidental damage being thereby provided. The valve 256 may be safety-wired into position in a conventional manner, not shown.

Two lock pin apertures 260, formed radially through the cap 44 in the threaded region 240 at 180° spacings, have smaller diameter pin retaining inner portions 262 communicating with the inner surface 248.

Threading of the end cap 44 into the cylinder 40 is facilitated by forming four equally spaced, rearwardly opening recesses 266 (FIG. 1) into the cap rear face 250 for receiving portions of conventional spanner-type wrenchs.

In the embodiment illustrated, the housing 46, configured to receive the buffer chamber 62, is a separate structural member which is detachably mounted to the cylinders 30 by the elements 32. Upon being received into the housing 46, the chamber 62 is maintained in the required buffer position rearwardly of the breech ring 26. For other types of cannon, as above mentioned, the buffer chamber 62 may alternatively be received directly into appropriately configured regions of a conventional receiver which functions in the same manner as the housing 46.

Figure 7:
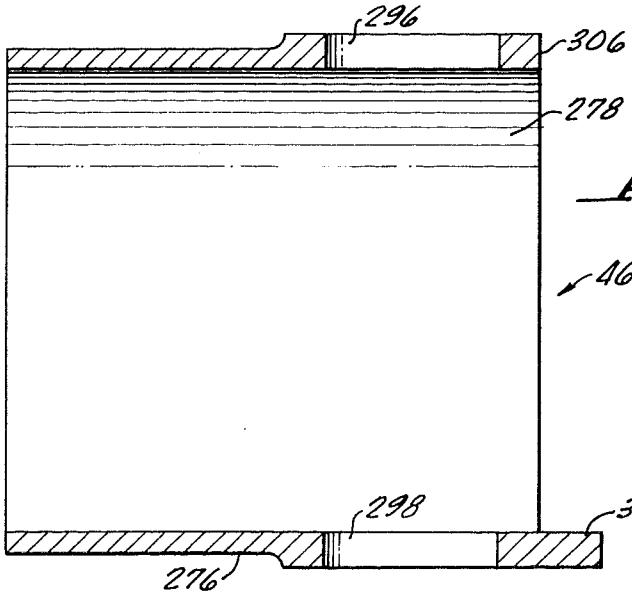
FIG. 7 is a vertical sectional view, taken along line 7—7 of FIG. 2, showing features of a housing portion of the buffer apparatus.

For the particular type cannon 22 illustrated, or for similar guns, the housing 46, as shown in FIGS. 1, 2 and 7, includes a hollow, generally cylindrical central portion 276 having a large axial aperture 278 for receiving the cylinder 40, and hence the buffer chamber 62. Extending sidewardly from the central portion 276, in a symmetrical manner and about a horizontal plane through the buffer axis, are large first and second mounting lugs 280 and 282, respectively. Longitudinal mounting apertures 284 and 286 are formed parallel to the buffer axis through the lugs 280 and 282, respectively, for receiving the cylinders 30. Apertures 288 and 290, orthogonally intersecting the apertures 284 and 286, are formed through upper portions of the lugs 280 and 282 for receiving the locking elements 32 which releasably lock the housing 46 to the cylinders 30 upon assembly.

An additional aperture 292 in the lugs 282 (FIG. 1) orthogonally intersects the aperture 290 for receiving one of the detent pins 34 which retains the associated element 32 in position by conventional detent means (not shown). A similar aperture (not shown) is formed in the first lug 280 for the same purpose.

Upper and lower, elongate slots or apertures 296 and 298, respectively, are formed through the central portion 276 about a vertical plane through the buffer axis. Such slots 296 and 298 are positioned to coincide, respectively, with the buffer cylinder slots 112 and 114 when the cylinder 40 is received fully rearwardly into the housing 46. However, as can be seen, for example, in FIG. 8, the housing slots 296 and 298 are slightly shorter in a forward direction than the cylinder slots 112 and 114 so that the housing 46, rather than the cylinder 40, functions as a forward piston stop, as below described.

Threaded recesses 300, formed in the housing central portion 276 adjacent the upper slot 296, receive the cap screws 56, for installation of the upper one of the plates 52. Similar recesses (not shown) are provided adjacent the lower slot 218 for the same purpose.

For the specific type cannon 22 illustrated, a short lug 304 extends forwardly from a transverse forward housing face 306 in a region below the aperture 278 for abutting other portions of the cannon 22, as hereinafter described. Outer ends of the lugs 280 and 282 terminate in T-shaped regions 312 and 314, respectively, by means of which the housing may be axially slidably received in cannon mount tracks 316 (FIG. 1). Corresponding mounting regions, one region 318 thereof being shown, are formed on the breech ring 26 for the same purpose. Similar regions are formed, as well, on members to which forward ends of the cylinders 30 are fixed.

Assembly and Operation

With the piston 42 and end cap 44 individually assembled as described above, the buffer chamber 62 is assembled (FIG. 8) by first inserting the piston forwardly into the buffer cylinder 40 until the piston forward portion 172 projects forwardly through the forward cylinder aperture and beyond the cylinder face 94. Next, the end cap 44, with the cap face 254 forward, is screwed into the threaded cylinder end portion 72 until one of the cap apertures 260 is registered with the cylinder aperture 124. A lock pin 320 (see also FIG. 2) is then installed downwardly into the aligned apertures 124 and 260 to prevent unintended loosening of the end cap 44 from the cylinder 40, as might otherwise be caused by impact, shock and vibration associated with firing the cannon 22.

It is emphasized that relative configuration of the cylinder 40, piston 42 and end cap 44 is such that such assembly of the chamber in the described manner is possible and that after assembly a gas pressure chamber 322, having a preselected maximum (static) volume, is formed between the piston cylinder and end cap and rearwardly of the slots 112, 114, 296 and 298. Thus, the pressure chamber 322, which has a variable volume according to relative positioning of the cylinder 40 and piston 42, is bounded or defined by the first and second piston recess surfaces 182 and 186, the piston annular rear face 184, the end cap forward face 254, an annular cap surface 324 surrounding such forward face and the inner wall surface 104 of the cylinder 40.

Pressure sealing of the chamber 322, to prevent loss of gas therefrom after pressurization, is by means of the piston seal 124, the end cap seal 242, and a seal or seals (not shown) associated with the pressure valve 256.

After assembly in this manner of the cylinder 40, piston 42 and end cap 44, and preferably before pressurizing the pressure chamber 322, the composite buffer chamber 62 is installed rearwardly into the housing aperture 278. With the cylinder 40 and the piston 42 oriented and positioned, relative to each other and the housing 46, so that the piston pin aperture 200, the cylinder slots 112 and 114 and housing slots 296 and 298 are all aligned, the piston pin 52 is installed into the piston aperture. To secure the piston pin 52 in this position, the plates 54 are fastened to the outside of the housing 46 with the cap screws 56. To prevent loosening in operation, the screws 56 may be safely wired in position in a conventional manner (not shown).

Assembly of the buffer apparatus 20 is completed by connecting the sear 48 to the cylinder sear bracket portion 74 by the pin 50 which passes through the corresponding cylinder and sear apertures 86 and 140. Upon such installation, the sear springs 150 and 152 are received in respective sear apertures 146 and 148 and the cylinder recesses 88. Because of the resulting interdigitation of the corresponding cylinder ears 82 and 84 and the sear ears 130 and 132 and central portion 134, the sear pivot pin 50 has four shear areas, enabling use of a smaller diameter pivot pin than would otherwise be necessary. Use of a smaller diameter pivot pin 50 enables corresponding reduction in size of the sear 48 and sear bracket portion 74 over that otherwise required. Accordingly, resistance of the sear 48, sear bracket portion 74 and sear pin 50 to high sear-bolt assembly engagement stresses during searing up is thereby provided without excessive size or weight of the parts involved. The pin 50 may be retained by a roll pin 326 (FIG. 2).

Pressurization of the buffer apparatus 20, that is, of the pressure chamber 322, through the pressure valve 256, which is exposed through the housing aperture 278, may be accomplished either before or after connection of the buffer apparatus to the cylinders 30. For such connection, the buffer apparatus 20 is slid forwardly onto rear ends of the cylinders 30, the cylinders being received in the housing apertures 284 and 286. As the buffer apparatus 20 is being so installed onto the cylinders 30, for the particular type cannon 22 illustrated, the housing lug 304 is brought into abuttment with a mating portion 332 of a bolt assembly guiding plate assembly 334 which extends between the buffer and the breech ring 26. In this manner, the housing 46 also serves to help support the rearward end of the plate assembly 334.

When the buffer apparatus 20 is positioned with the housing apertures 288 and 290 aligned with corresponding apertures (not shown) in the cylinders 30, the elements 32 are downwardly installed to secure the housing 46 to the cylinders. The detent pins 34 are then installed through the housing (for example, through the aperture 290) and into corresponding recesses 36 in the elements 32 to prevent accidental release of the elements.

Disassembly of the buffer apparatus 20 from the cannon 22 and into individual components is accomplished in the reverse manner of assembly. The described manner of buffer apparatus construction enables ready access to the pressure valve 256 for pressurizing the pressure chamber 322 and checking pressure therein, without removing any portions of the buffer apparatus 20 from the cannon 22. For servicing, repair or replacement, the entire buffer 20 can be easily and rapidly removed and reinstalled without special tools. This feature is particularly important if replacement or repair in combat situations is necessary, and also to help assure that adequate preventive maintenance is performed.

Figure 8:
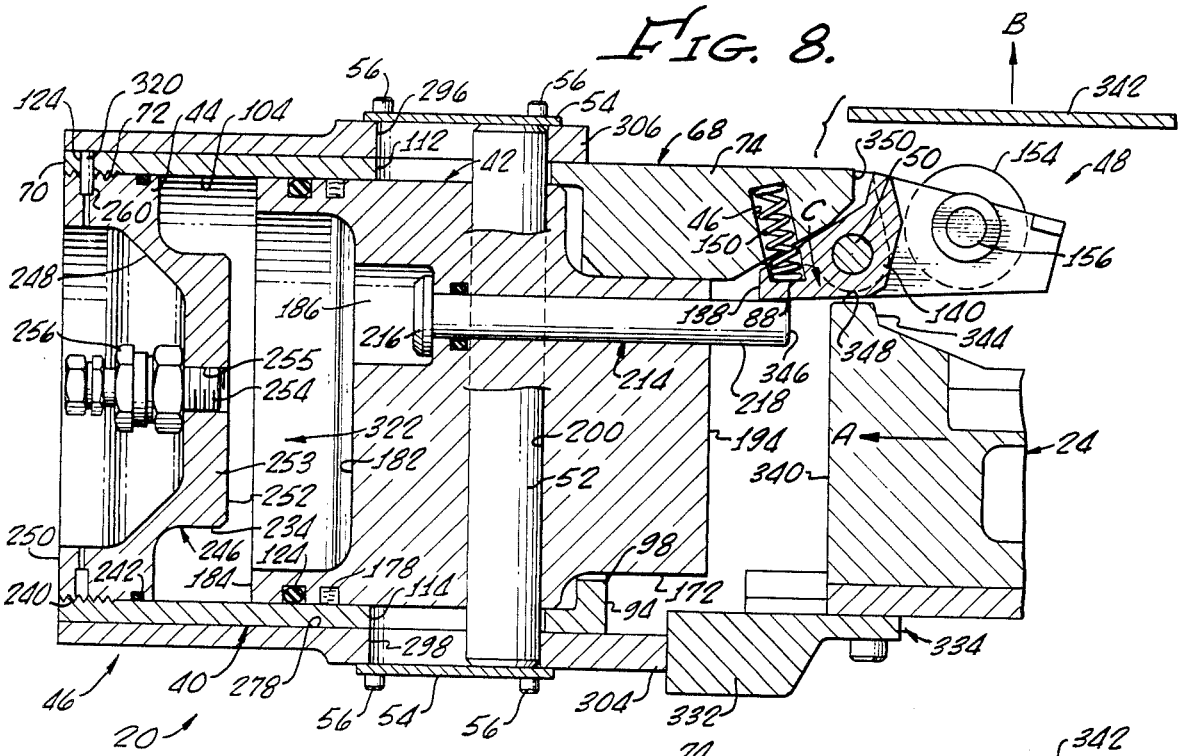
FIG. 8 is a vertical cross-sectional view of the assembled buffer apparatus, showing a bolt assembly portion of the cannon recoiling into close proximity to the buffer piston after firing and showing the sear released and supported by a sear keeper pin.

From FIG. 8, it can readily be seen that the piston pin 52, as installed in the piston aperture 200 and as confined in the cylinder slots 112 and 114 and the housing slots 296 and 298, largely controls permissable relative movement between the piston 42, the cylinder 40 and the housing 46 during buffer operation.

After assembly, when the pressure chamber 322 is fully pressurized for operation, for example, with gaseous nitrogen to several hundred psi, the piston 42 is pushed or urged to its forwardmost position relative to the housing 46 and the cylinder 40, forward piston travel being limited by ends of the piston pin 52 bearing against forward ends of the housing slots 296 and 298, it being recalled that the housing slots extend less far forwardly than do the cylinder slots 112 and 114 so that piston stopping by the stronger housing is provided. At this static, forwardmost piston position, volume of the pressure chamber 322 is at a maximum.

It should also be observed that when the pressure chamber 322 is pressurized, the sear keeper pin 214 is pushed to its forwardmost position relative to the piston 42, the pressurized gas in the chamber thus functioning as a sear keeper spring. Otherwise, separate sear keeper urging means, such as springs, would be necessary.

Furthermore, the cylinder and housing slots 112, 114, 296 and 298 are relatively positioned so that with the pressure chamber 322 pressurized, and thus with ends of the piston pin 52 at forward ends of the housing slots, the cylinder 42 is pushed to its rearward most position relative to the housing 46. In this rearwardmost cylinder position a rear face 338 (FIG. 2) of the cylinder flange 64 bears against the housing forward face 306, thereby preventing further rearward movement of the cylinder 42 relative to the housing 46.

That pressurizing the pressure chamber 322 does, in fact, move the cylinder 40 rearwardly relative to the housing 46 at the same time as the piston 42 is pushed forwardly relative to the cylinder, is apparent from the fact that the cylinder can only be forward of its rearwardmost position when forward ends of the cylinder slots 112 and 114 are forward of forward ends of the corresponding housing slots 296 and 298. This, however, would require ends of the piston pin 52 to be rearwardly of forward ends of the cylinder slots 112 and 114, a condition contrary to what actually occurs when the chamber 322 is pressurized.

Thus, in the static, pressurized condition any permissible relative axial movement between the cylinder 40, the piston 42 and the housing 46 is opposed by internal axial forces caused by the pressurized gas in the pressure chamber 322.

During firing, two conditions may occur when the bolt assembly 24 is driven rearwardly in recoil towards the buffer 20. One condition, associated with automatic repetitive firing, is that, on counterrecoil from the buffer apparatus 20, the bolt assembly 24 will not be seared up by the sear 48. Instead, the bolt assembly 24 will continue forwardly to pick up and fire another shell. The other condition, associated with single shot operation or with termination of a burst, is that, after leaving the buffer apparatus 20 in counterrecoil, the bolt assembly 24 will be seared up by the sear 48. Which condition will exist at any particular instant of firing is generally a matter of operator selection which may be implemented in any conventional manner.

For both conditions, however, operation of the buffer apparatus 20 to absorb bolt assembly recoil and impart counterrecoil thereto is identical. Hence, the following discussion is principally directed to the second, searing up condition, in which the buffer apparatus 20 also functions to reduce sear-bolt assembly engagement stresses.

FIG. 8 illustrates the buffer apparatus 20 in the above described, static pressurized state, with the bolt assembly 24 recoiling (direction of arrow A) after firing and with an impacting rear face 340 of the bolt assembly closely approaching the buffer piston 42. Since a searing-up decision is assumed to have been made, a plate 342 associated with a trigger mechanism (not shown) is raised (direction of Arrow B) out of engagement with the sear roller 154. Thus, under action of the sear springs 150 and 152, rearward portions of the sear 48 are urged downwardly (direction of Arrow C) about the pivot pin 50 towards a position which would enable the sear surface 138 to engage a corresponding forward facing, surface 344 on upper regions of the bolt assembly 24.

In order, however, for the searing surfaces 138 and 344 to engage one another to cause searing up of the bolt assembly 24, rearward portions of the sear 48 must be positioned below upper portions of the bolt assembly. Since decisions to sear up are normally made just after firing and while the bolt assembly 24 is recoiling towards the buffer 20, downwardly urged rearward portions of the sear 48 can be expected to be in the recoil path of the bolt assembly and be impacted thereby.

It has been found, though, that when impacting of the released sear 48 by the recoiling bolt assembly 24 occurs, impacted portions of the sear are driven back upwardly against the springs 150 and 152, and sear bouncing is caused to such an extent that subsequent proper searing up of the bolt assembly may be unreliable. At times, a complete failure to sear occurs; at other times searing is marginal and unintended firings caused by jarring of the cannon 22 may occur.

Preventing such sear bouncing and thereby assuring reliable and complete searing up of the bolt assembly 24 is the function of the sear keeper pin 214. As mentioned, under static, pressurized buffer conditions, the forward portion 218 of the sear keeper pin 214 projects forwardly from the piston 42 under rearward end portions of the sear 48 in a position that when the sear is released for searing up, the sear rests on the sear keeper pin and does not pivot downwardly into the recoil path of the bolt assembly 24.

Figure 9:
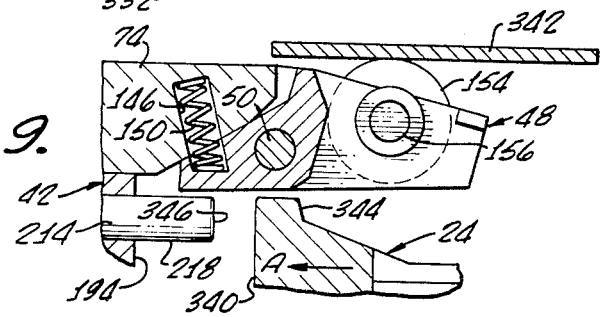
FIG. 9 is a partial vertical cross-sectional view, similar to FIG. 8, but showing the sear held in an unreleased condition for continued firing and unsupported by the sear keeper pin.
Figure 10:
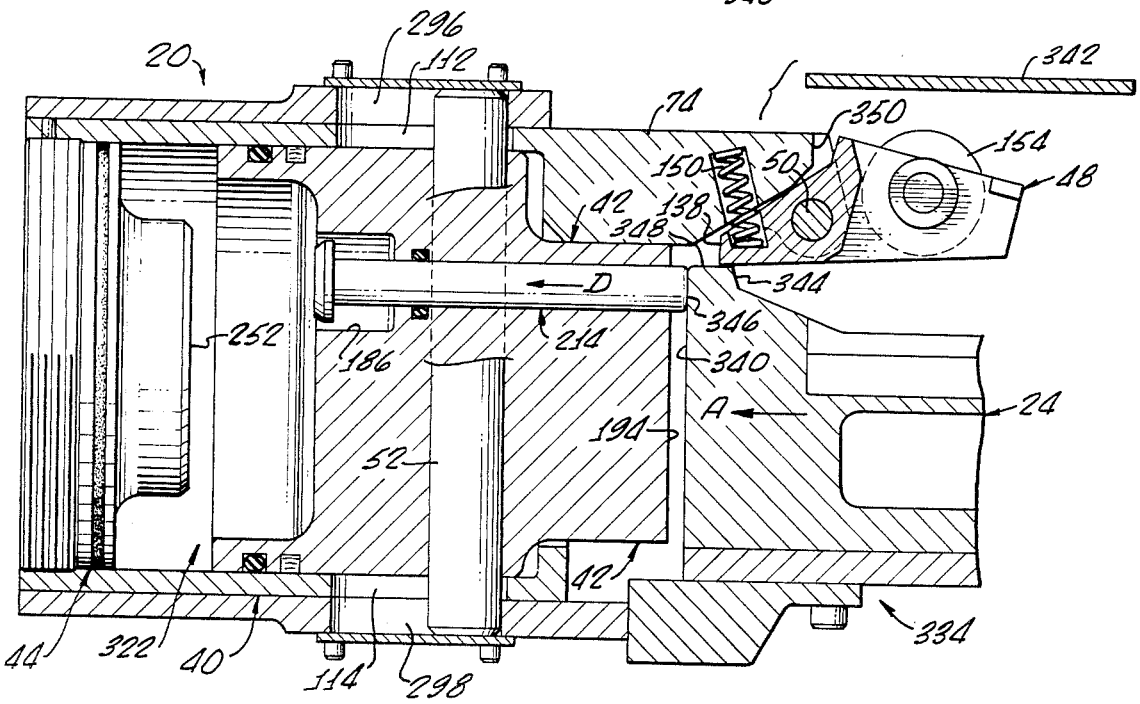
FIG. 10 is a cross-sectional view similar to FIG. 8, but at an instant later, showing the recoiling bolt assembly driving the sear keeper pin out of support of the sear.

In contrast, as seen in FIG. 9 for the automatic firing condition, the sear 48 is held retracted by the trigger actuated sear plate 342. Consequently the sear 48 does not rest on the pin 214, the pin being non-functional for this firing condition.

Returning to discussion of the interrupted or cease firing condition, as is seen in FIGS. 8 and 10–14, the sear keeper pin 214 is itself disposed in the recoil path of the bolt assembly 24, thereby enabling the pin, upon impact, to be driven rearwardly into the piston 42 by the bolt assembly, and hence out of supporting relationship with the sear 48.

As a consequence, the recoiling bolt assembly 24, as the buffer apparatus 20 is more closely approached an instant later, impacts a forward face 346 of the sear keeper pin 214 (FIG. 10) and starts driving the pin rearwardly into the piston 42 (direction of Arrow D) against forward urging forces provided by gas pressure in the pressure chamber 322. This occurs before the piston 42 is impacted by the bolt assembly 24. It is to be appreciated that the pin 214 is impacted and driven rearwardly in this manner at each recoil cycle of the bolt assembly 24, regardless of whether the pin is supporting the sear 48.

Driving of the pin 214, by the bolt assembly 24, out of supporting relationship with the released sear 48 instantaneously transfers support of the sear to an upper surface 348 of the bolt assembly 24, sear rotation about the pin 50 still being prevented, without impact, as the bolt assembly recoils under the sear.

Another instant later, as seen in FIG. 11, the rear face 340 of the still recoiling bolt assembly 24 has driven the sear keeper pin 214 completely into the piston 42, has impacted the forward piston face 194 and has started driving the piston rearwardly (direction of Arrow E) into the cylinder 40 and towards the end cap 44. As described above, rearward movement of the cylinder 40 is prevented by the cylinder flange 64 bearing against the buffer housing face 306 (FIG. 2).

In FIG. 11 the recoiling bolt assembly 24 is shown having driven the piston 42 rearward, (direction of Arrow E) to an intermediate position in which ends of the piston pin 52 are approximately centered in the cylinder and housing slots 112, 114, 296 and 298. In this position, volume of the gas chamber 312 has been substantially reduced and pressure of the gas substantially increased over the static value.

At the instant of time represented in FIG. 11, the bolt assembly 24 has recoiled rearwardly out of support of the sear 48, thereby permitting the sear to continue pivoting about the pivot pin 50 (direction of Arrow C) under urging by the sear springs 150 and 152, until the sear surface 138 is down to the proper searing elevation and forwardly of the corresponding bolt assembly sear surface 344. Abutting surfaces 164 and 166 of the sear and a corresponding surface 350 on the sear bracket portion 74 at this point engage to stop sear rotational movement.

Recoiling of the bolt assembly 24 continues, at diminishing velocity until all the recoil kinetic energy thereof is absorbed by the buffer apparatus 20 by compression of the gas in the chamber 322. At the instantaneous equilibrium position of FIG. 12, recoil movement of the bolt assembly 24 is completely stopped with maximum gas pressure in, and minimum volume of, the gas chamber 322 (for a particular initial pressure and recoil energy).

Assuming the chamber 322 has been pressurized to an appropriately high static pressure, recoil of the bolt assembly 24 is solely stopped by further compression of gas in the pressure chamber, and without mechanical engagement between any portions of the buffer apparatus 20. That is, rearward movement of the piston 42 stops with ends of the piston pin 52 still slightly forwardly of rearward ends of the cylinder and housing slots 112, 114, 296 and 298 and with no contact between the piston 42 and the cylinder end cap 44. Accordingly, virtually all the transferred bolt assembly recoil energy is stored in the compressed buffer gas, and a buffer efficiency of substantially 100 percent is made possible.

If, however, gas pressure in the chamber 322 is lost, for example, by seal leakage, to an extent that subsequent pressurization of the gas in response to bolt assembly recoil impact on the piston 42 cannot completely stop bolt assembly recoil, rearward ends of the slots 112, 114, 296 and 298 function as stops for the pin 52, thereby stopping rearward travel of the piston 42 and bolt assembly 24. Under such uninteded conditions, however, it will be understood that buffer efficiency may be substantially reduced, with corresponding reduction of cannon firing rate, and mechanical damage to the buffer apparatus 20 may occur.

After bolt assembly recoil has stopped in the manner described, gas in the gas chamber 322 instantaneously starts reexpanding to drive the piston 42 and the bolt assembly 24 back forwardly in counterrecoil.

If firing of the cannon 22 is not to be interrupted by searing up of the bolt assembly 24, by the sear 48, the bolt assembly continues counterrecoil travel to the breech ring 26, forward piston travel being stopped by the pin 52 reaching forward ends of the housing slots 296 and 298. The described cycle is repeated until searing up occurs or the cannon otherwise stops firing.

When the described searing up condition is selected and the sear 48 is released to the position shown in FIGS. 11 and 12, the bolt assembly sear surface 344 engages the sear surface 138 just after leaving the piston 42 in counterrecoil (direction of Arrow F, FIG. 13). In asmuch as the searing up occurs when the bolt assembly 24 has substantially maximum counterrecoil velocity, the bolt assembly impacts the sear 48 with very high kinetic energy.

This high bolt assembly-sear impact energy causes the still counterrecoiling bolt assembly 24, through the sear 48, to drag or pull the buffer cylinder 40 forwardly relative to the fixed housing 46 (direction of Arrow G). Forward travel of the piston 42 with the cylinder 40 is prevented by the piston pin 52 engaging forward ends of the housing slots 296 and 298. However, the cylinder slots 112 and 114 enable the cylinder 40 to move forwardly, relative to the piston 42, a limited distance with the bolt assembly 24.

As the cylinder end cap 44 is pulled forwardly in this manner with the cylinder 40 towards the piston 42, gas in the gas chamber 322 is again compressed, bolt assembly-sear impact energy being thereby absorbed to bring the counterrecoiling bolt assembly 24 to a non-abrupt stop. Because of this buffered bolt assembly-sear impact, involved components, such as the sear bracket portion 74, the sear 48 and the sear pivot pin 50, can be constructed smaller and lighter in weight than would otherwise be possible, as is important to minimize overall cannon size and mass.

Subsequent immediate reexpansion of gas in the pressure chamber 322, after bolt assembly counterrecoil is stopped, pulls the cylinder 40 and hence, through the sear 48, the bolt assembly 24, back rearwardly to a seared-up, equilibrium position (FIG. 14). In such position, the cylinder 40 is pulled slightly forwardly of its rearwardmost position against the housing 46 by springs 352 (FIG. 1) connected to the bolt assembly 24 for driving the bolt assembly, on unsearing, forwardly to the breech ring 26.

By way of a specific illustrative example, with no limitations intended or implied, the pressure chamber 322, when the buffer 20 is constructed for use with a 35 mm cannon having a bolt assembly 24 weighing approximately 20 pounds and a recoil velocity in the approximate range of 40 to 60 feet per second, has an initial, static volume of about 22 cubic inches. With about one inch of axial piston travel permitted by the piston pin 52 at the maximum rearward position of the piston 42 relative to the cylinder 40 volume of the pressure chamber 322 is reduced to about $6\frac{1}{4}$ cubic inches, or to about $\frac{1}{3}$ of the static volume. The chamber 322 is initially pressurized to a pressure of about 375 psi with gaseous nitrogen maximum pressure at minimum chamber volume thus being no more than about 1000 psi.

As previously mentioned, specific configuration and dimensions of the buffer apparatus 20 and components thereof may be varied as necessary to enable adaptation to particular gun configurations as well as to particular performance criteria, such as bolt assembly recoil velocity.

Although there has been described above a specific arrangement of a double acting gas (pneumatic) buffer in accordance with the invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. In an automatic cannon having a breech, a bolt assembly mounted for reciprocating movement along a recoil and counterrecoil path and triggering means for selectively controlling movement of the bolt assembly and firing of the cannon, double acting recoil and sear buffer apparatus, which comprises:

(a) a buffer housing disposed on the cannon rearwardly of the breech;

(b) a pneumatic buffer disposed in the housing, said buffer including a cylinder, means for closing a rearward end of the cylinder and a piston axially slidably disposed in the cylinder, said buffer further including searing means fixed to forward regions of the cylinder and responsive to the triggering means for searing up the bolt assembly on counterrecoil thereof, said cylinder, said means for closing the rearward end thereof and said piston forming a gas pressure chamber adapted for containing a pressurized gas, said piston being operative for being driven rearwardly and compressing the pressurized gas contained in the pressure chamber in response to rearwardly directed bolt assembly recoil impact, said pressurized gas in the pressure chamber re-expanding after bolt assembly recoil is stopped to drive the bolt assembly towards the breech at a counterrecoil velocity approximately equal to bolt assembly recoil velocity, and said cylinder being operative for being driven forwardly and compressing the pressurized gas contained in the pressure chamber in response to forwardly directed searing up impact of the bold assembly against said searing means to soften bolt assembly searing up; and, (c) travel limiting means for preventing rearward axial movement of the cylinder when the piston is driven rearwardly in response to bolt assembly recoil impact thereagainst and for preventing forward axial movement of the piston when the cylinder is driven forwardly in response to searing up impact of the bolt assembly against the searing means;

said travel limiting means including means defining corresponding slots in the housing and in the cylinder forwardly of the pressure chamber, said slots being elongated in a direction parallel to a barrel bore axis, said travel limiting means further including a piston pin mounted in the piston along an axis orthogonal to said bore axis, ends of the pin extending into said corresponding slots, axial travel of the pin and the piston in both rearward and forward axial directions, relative to the cylinder and housing, being thereby limited.

2. The buffer apparatus according to claim 1, including means for releasably retaining the piston pin in the buffer, said retaining means including at least one retaining plate and means for detachably mounting the plate to an exterior surface the housing over the slot therein.

3. The buffer apparatus according to claim 2, wherein said housing and cylinder slots are formed having axial lengths enabling said piston to travel rearwardly relative to the cylinder and housing, in response to bolt assembly recoil impact without the piston pin engaging rearward ends of said slots so long as pre-impact static gas pressure in the pressure chamber is maintained at a preselected level, relative travel between the piston and cylinder, during bolt assembly recoil stopping, being thereby normally limited by increased pressure of the gas in the pressure chamber.

4. In an automatic cannon having a breech, a bolt assembly mounted for reciprocating movement along a recoil and counterrecoil path and triggering means for selectively controlling movement of the bolt assembly and firing of the cannon, double acting recoil and sear buffer apparatus, which comprises:

(a) a buffer housing disposed on the cannon rearwardly of the breech;

(b) a pneumatic buffer disposed in the housing, said buffer including a cylinder, means for closing a rearward end of the cylinder and a piston axially slidably disposed in the cylinder, said buffer further including searing means fixed to forward regions of the cylinder and responsive to the triggering means for searing up the bolt assembly on counterrecoil thereof, said cylinder, said means for closing the forward end thereof and said piston forming a gas pressure chamber adapted for containing a pressurized gas, said piston being operative for being driven rearwardly and compressing the pressurized gas contained in the pressure chamber in response to rearwardly directed bolt assembly recoil impact, said pressurized gas in the pressure chamber re-expanding after bolt assembly recoil is stopped to drive the bolt assembly towards the breech at a counterrecoil velocity approximately equal to bolt assembly recoil velocity, and said cylinder being operative for being driven forwardly and compressing the pressurized gas contained in the pressure chamber in response to forwardly directed searing up impact of the bolt assembly against said searing means to soften bolt assembly searing up; and, (c) travel limiting means for preventing rearward axial movement of the cylinder when the piston is driven rearwardly in response to bolt assembly recoil impact thereagainst and for preventing forward axial movement of the piston when the cylinder is driven forwardly in response to searing up impact of the bolt assembly against the searing means;

said travel limiting means including an outwardly extending flange formed around at least portions of the cylinders in forward regions thereof, said flange engaging corresponding forward portions of the housing to limit rearward axial travel of the cylinder relative thereto.

5. In an automatic cannon having a breech, a bolt assembly mounted for reciprocating movement along a recoil and counterrecoil path and triggering means for selectively controlling movement of the bolt assembly and firing of the cannon, double acting recoil and sear buffer apparatus, which comprises:

(a) a gas pressure chamber adapted for containing a gas under pressure and means for mounting said chamber rearwardly of said breech;

(b) searing means connected to said chamber and responsive to said triggering means for searing up the bolt assembly on counterrecoil thereof and for unsearing the bolt assembly for firing;

(c) means for causing further compression of pressurized gas contained in the chamber both in response to bolt assembly recoil impact after firing, to stop bolt assembly recoil, and to bolt assembly searing up impact with said searing means to soften searing up of the bolt assembly, said compression means being operative for enabling subsequent rapid reexpansion of the pressurized gas contained in the chamber after bolt assembly recoil is stopped to cause counterrecoil of the bolt assembly towards the breech at a velocity approximately equal to the recoil velocity thereof; and, (d) means when the searing means is controlled by the triggering means to move to a bolt assembly searing position, for preventing impact between the searing means and the bolt assembly during bolt assembly recoil, said preventing means including a sear keeper having sear support portions positioned to be moveable by the bolt assembly, on recoil impact thereby, from a first position supporting the searing means out of the bolt assembly recoil path to a second position releasing the searing means to enable searing up of the bolt assembly on counterrecoil, and further including biasing means for urging said sear support portion towards said first position.

6. The buffer apparatus according to claim 5, wherein the sear keeper comprises an elongate sear keeper pin and means slidably mounting the pin through the pressure chamber on an axis parallel to the bolt assembly recoil and counterrecoil path with said sear support portions directed forwardly towards the breech, and wherein said biasing means comprises the pressurized gas in the pressure chamber, the pressurized gas pushing forwardly against rearward end portions of the sear keeper pin to thereby cause forward urging thereof.

7. In an automatic cannon having a breech, a bolt assembly mounted for reciprocating movement along a recoil and counterrecoil path and triggering means for selectively controlling movement of the bolt assembly and firing of the cammon, double acting recoil and sear buffer apparatus, which comprises:

(a) a buffer having spring means disposed therein for providing energy absorption and return;

(b) means for mounting said buffer rearwardly of said breech;

(c) searing means connected to said buffer and responsive to said triggering means for enabling searing up the bolt assembly on counterrecoil thereof and for unsearing the bolt assembly for firing the cannon;

(d) means for causing compression of the spring means disposed in the buffer in response both to bolt assembly recoil impact after firing, to stop bolt assembly recoil, and to bolt assembly searing up impact with said searing means to soften searing up of the bolt assembly, said spring means, after stopping bolt assembly recoil, causing counterrecoil of the bolt assembly towards the breech; and (e) means, when the searing means is controlled by the triggering means to move to a bolt assembly searing position, for preventing impact between the searing means and the bolt assembly during bolt assembly recoil before searing up, said impact preventing means including a sear keeper having a sear support portion mounted to be moveable by the bolt assembly, on recoil engagement therewith, from a first position supporting the searing means out of the bolt assembly recoil path to a second position releasing the searing means to enable searing up of the bolt assembly on counterrecoil, and further including biasing means for urging said sear support portion towards said first position.

8. The buffer apparatus according to claim 7, wherein the sear keeper comprises an elongate sear keeper element and means slidably mounting said element to the buffer on an axis parallel to the bolt assembly recoil and counterrecoil path, with said sear supporting portion directed forwardly towards the breech.

9. The buffer apparatus according to claim 8, wherein said buffer spring means comprises a pressurized gas chamber and wherein said sear keeper element extends into said chamber, the pressurized gas chamber thereby also comprising the sear keeper biasing means.

* * * * *

UNITED STATES PATENT AND TRADEMARK OFFICE

CERTIFICATE OF CORRECTION

PATENT NO. : 4,282,796

DATED : August 11, 1981

INVENTOR(S) : Eugene M. Stoner

It is certified that error appears in the above—identified patent and that said Letters Patent is hereby corrected as shown below:

Column 2, line 26: Change "seam" to -- sear --

Column 3, line 11: Change "M61A11" to --M61A1--

Column 8, line 62: Change "forward" to --forwardly--

Column 9, line 1: After "sear" insert --48--

Column 9, line 9: Before "forces" insert --by downward--

Column 13, line 37: Delete "36" and insert --336--

Column 17, line 53: After "nitrogen" insert --,--

Column 19, line 46: Delete "cylinders" and insert --cylinder--

Column 20, line 7: After the first occurrence of "means" insert --,--

Signed and Sealed this

Sixteenth Day of March 1982

[SEAL]

Attest:

GERALD J. MOSSINGHOFF

Attesting Officer

Commissioner of Patents and Trademarks